US005857240A

United States Patent [19]

Park et al.

[11] Patent Number: 5,857,240

[45] Date of Patent: Jan. 12, 1999

[54] VACUUM CLEANER

[75] Inventors: Yi-Song Park; Sung-Ho An, both of Kwangju, Rep. of Korea

[73] Assignee: Kwangju Electronics Co., Ltd., Kwangju, Rep. of Korea

[21] Appl. No.: 843,272

[22] Filed: Apr. 14, 1997

[30] Foreign Application Priority Data

Apr. 19, 1996 [KR] Rep. of Korea ..... 1996-8635 U

[51] Int. Cl.[6] ..... A47L 5/00

[52] U.S. Cl. ..... 15/327.2; 15/339

[58] Field of Search ..... 15/339, 327.1, 15/327.2, 327.5, 323

[56] References Cited

U.S. PATENT DOCUMENTS 2,779,432 1/1957 Meyerhoefer ..... 15/323 X
3,401,420 9/1968 Lofgren ..... 15/315 X
4,509,227 4/1985 Keane ..... 15/327.2 X
5,144,716 9/1992 Watanabe et al. ..... 15/327.2 X

*Primary Examiner*—Chris K. Moore
*Attorney, Agent, or Firm*—Staas & Halsey

[57] ABSTRACT

A vacuum cleaner with a main body, an upper body and a lower body. The upper body, in which a motor and dust collector are installed, is joined to the lower body, which supports the upper body and also allows the rotation of the upper body. Coupling means joins the upper body to the lower body so as to allow the upper body to rotate on the lower body. One of the coupling means is fixed on the upper body's bottom center, and the other end is a shaft that is joined to the lower body's top center. A bearing member is installed between the upper body's bottom and the lower body's top surface so as to reduce frictional resistance between the two components. The bearing member includes grooves formed on the top surface of the lower body, and balls seated in the grooves that move freely therein, thereby preventing damage to a connecting hose connecting the cleaner's cleaning attachment with the main body.

3 Claims, 3 Drawing Sheets

VACUUM CLEANER

BACKGROUND OF THE INVENTION (1) Field of the Invention

The present invention generally relates to a vacuum cleaner. More particularly, it relates to the main body of a vacuum cleaner which produces a vacuum to draw up dust and loose dirt from rugs and other surfaces.

(2) Description of the Prior Art

A conventional vacuum cleaner is used to clean floors and floor coverings by drawing up the dirt from them in air. It does this by using a vacuum created by the difference between the internal pressure of the cleaner's main body and the atmospheric pressure. FIG. 3 illustrates the overall construction of a conventional vacuum cleaner. It is comprised of a main body 10 equipped with a driving means (not illustrated) and a dust collecting means (not illustrated), a cleaning attachment 30 through which dirt and dust are drawn from surfaces to be cleaned by the vacuum generated in the main body 10, and an extension pipe 20 and a connecting hose 22 that connect the cleaning attachment 30 with the main body 10. The ends of the connecting hose 22 are respectively attached to the main body 10 and one end of the connecting joint 21, on which a handle 23 is formed. The other end of the connecting joint 21 is connected to the extension pipe 20, which is also fitted with the cleaning attachment 30, so that the extension pipe 20 may communicate with the connecting hose 22. Reference numeral 24 denotes a control portion.

The main body 10 produces a vacuum by the operation of a motor (not illustrated), the driving means, and includes a dust collecting bag that serves as the dust collecting means (not illustrated). The main body 10 also includes front and rear wheels 11 and 12 on its bottom for facilitating its movement.

The connecting joint 21 and the connecting hose 22, which are made of a flexible material, are passages through which dust and dirt are drawn into the main body of the vacuum cleaner. The cleaning attachment 30 includes a suction hole 31 that communicates with the extension pipe 20 through the cleaning attachment's 30 suction path 32, through which the dirt from a surface to be cleaned is drawn into the main body 10 along with air. Reference numeral 33 denotes a roller that allows the cleaning attachment 30 to move more easily.

Once a user turns on the conventional vacuum cleaner by using the control portion 24, the motor (not illustrated) of the main body 10 goes into action to create a vacuum. Thus, as the air is drawn into the main body 10 at high speeds sequentially through the cleaning attachment 30, the extension pipe 20, the connecting joint 21, and the connecting hose 22, the dirt and dust on surfaces to be cleaned are drawn into the main body 10's dust collecting bag (not illustrated) by way of the suction hole 31 and the suction path 32. That is, the dirt is inhaled through the cleaning attachment 30 by the vacuum created in the main body 10, and is finally collected in the main body 10 through the extension pipe 20 and the connecting hose 22.

Since the user cleans floors and floor coverings with this conventional vacuum cleaner, the user must move the cleaning attachment 30 over a large surface. Consequently, the main body 10 also moves about the floor. Though the front and rear wheels 11 and 12 accommodate frontwards and rearwards motion and allow the main body 10 to move smoothly in those directions, they can not provide for the smooth left or right rotation of the main body 10. Instead, the rotational force is applied to the end of the connecting hose 22 that is connected with the main body 10, thereby causing damage to the connecting hose 22. These factors pose an inconvenience to the user and a decrease of the vacuum cleaners's cleaning efficiency.

SUMMARY OF THE INVENTION

The present invention concerns a vacuum cleaner that obviates the aforementioned problems and disadvantages of the conventional art.

It is the objective of the present invention to provide a vacuum cleaner equipped with a main body that includes an upper body rotatably joined to the top of a lower body, thus facilitating cleaning and preventing damage to the connecting hose that connects the cleaner's cleaning attachment and the main body.

In order to obtain the aforementioned objective of the present invention, there is disclosed a vacuum cleaner that includes: a main body comprising an upper body, which generates a vacuum utilized to collect dirt and dust, and a lower body which supports the upper body and also allows the rotation of the upper body; and coupling means for joining the upper body to the lower body so as to allow the upper body to rotate on the lower body.

One end of the coupling means is fixed on the upper body's bottom center, and the other end has a shaft that is rotatably joined to the lower body's top center. A bearing member is installed between the upper body's bottom and the lower body's top surface so as to reduce the frictional resistance between the two components.

The bearing member includes grooves formed on the top surface of the lower body, and balls seated in the grooves that move freely therewithin, with their outer circumferences touching the bottom of the upper body.

DETAILED DESCRIPTION OF THE PREFERRED EMBODIMENTS

Preferred embodiments of the present invention will be described in detail with reference to the accompanying drawings.

Figure 1:
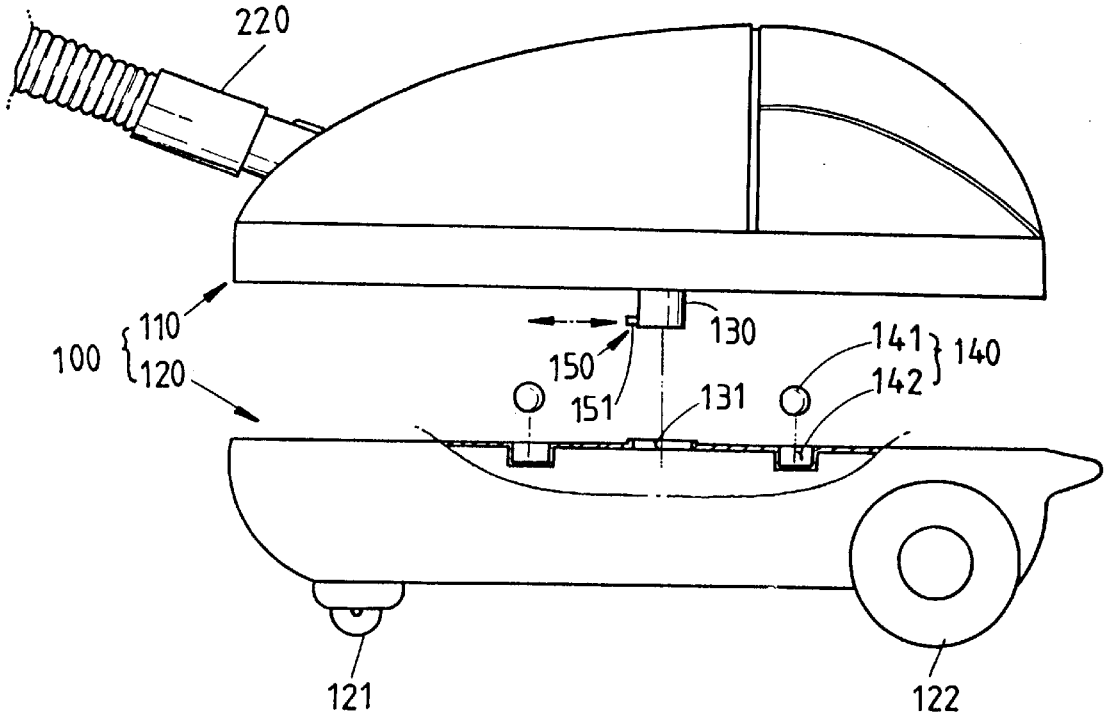
FIG. 1 is an exploded view of a vacuum cleaner's main body in accordance with the present invention.
Figure 2:
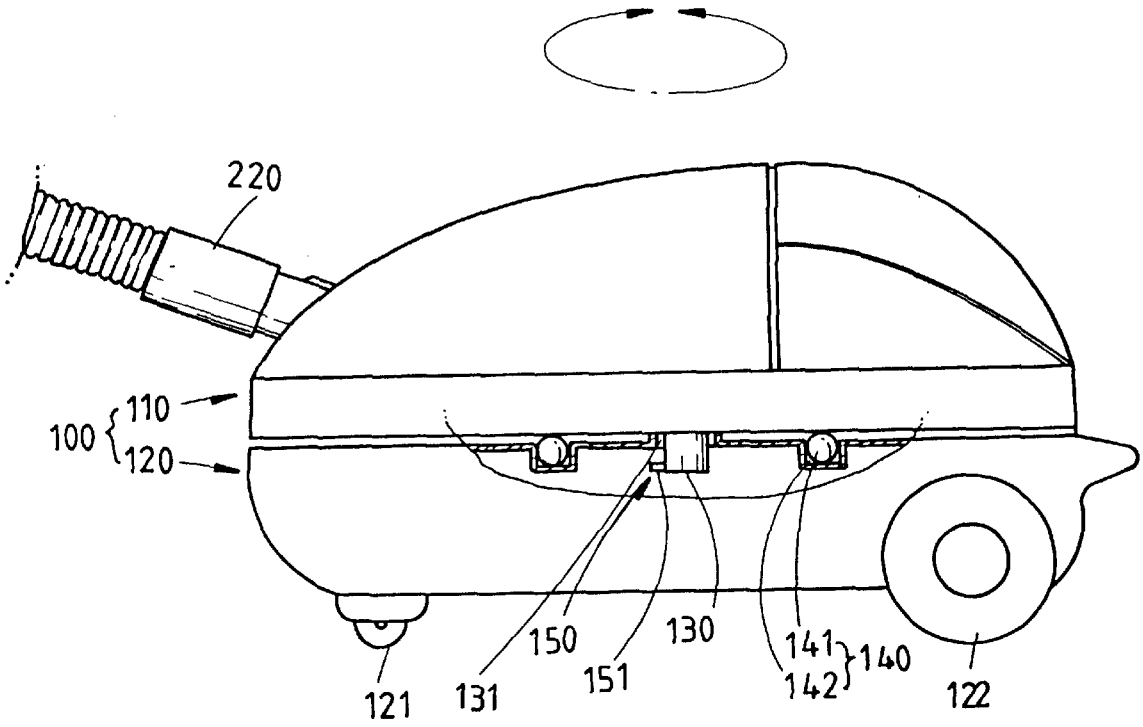
FIG. 2 is a side view of the vacuum cleaner's main body in accordance with the present invention.
Figure 3:
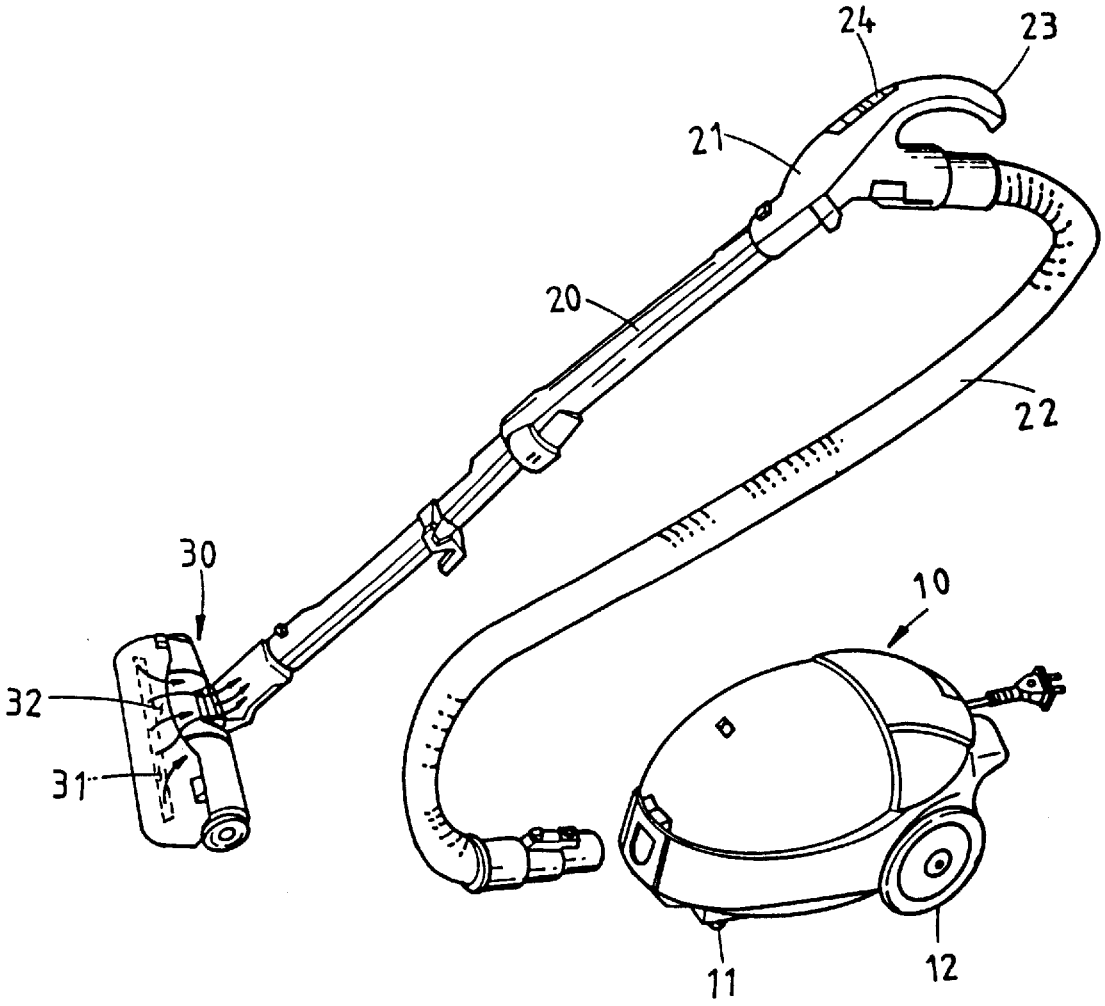
FIG 3 PRIOR ART
FIG. 3 is a perspective view of the overall construction of a conventional vacuum cleaner.

A vacuum cleaner of the present invention, as shown in FIGS. 1 and 2, has a main body 100 that serves to produce a vacuum for collecting drawn up dust and dirt. The main body 100 is comprised of an upper body 110 and a lower body 120.

The upper body 110 has driving means (not illustrated), which produces the vacuum, and dust collecting means (not illustrated), which collects inhaled dust and dirt. A connecting hose 220, through which dirt and dust are drawn into the main body 100, is connected with the upper body 110. This connecting hose 220 is connected through an extension pipe (not illustrated) and a connecting joint (not illustrated) that are coupled with a cleaning attachment (not illustrated). The lower body 120 has front and rear wheels 121 and 122 on its bottom so as to allow the main body to move more easily.

The upper body 110, a feature of the present invention, is rotatably joined to the lower body 120 by the use of coupling means, and its construction is more fully described as follows.

On the bottom center of the upper body 110 is a shaft 130 affixed thereto with bonding means and on the top center of the lower body 120, which supports the upper body 110, is a shaft hole 131 formed so that lower end of the shaft 130 securely fits therein. The lower end of the shaft 130 has a catching member 150 which prevents dislocation of the shaft 130 from the shaft hole 131. The catching member 150 is comprised of a projection 151 formed protruding outwards parallel with the lower body 120's longitudinal axis, and a spring (not illustrated) elastically biasing the projection 151.

As the shaft 130 is inserted into the shaft hole 131, the projection 151 is pressed inside the shaft 130. However, after the lower end of the shaft 130 is completely inserted into the shaft hole 131, the projection 151 returns to its outward position, thereby preventing the dislocation of the shaft 130 from the shaft hole 131.

A bearing member 140 is installed between the upper body 110 and the lower body 120 to reduce the frictional resistance between the two components, allowing the upper body 110 to rotate smoothly. The bearing member 140 includes a plurality of grooves 142 that are spaced a specified distance away from the shaft hole 131, and a plurality of balls 141 seated in the grooves 142. The upper body 110 is coupled with the lower body 120 so as to be rotatable about the shaft 130 while being supported by the balls 141. The balls 141 freely move in the grooves 142, and their outer circumferences are in contact with the bottom of the upper body 110, thereby reducing friction and decreasing the load on the shaft 131.

The following description relates to the operation of the vacuum cleaner's main body 100 in accordance with the present invention.

A user cleans floors, pushing and pulling the main body 100 of the vacuum cleaner, the smooth movement of which being facilitated by the front and rear wheels 121 and 122. This, in conjunction with the upper body 110 being coupled with the lower body 120 in a manner that allows it to rotate 360° about the shaft 130 (which allows the direction of the movement of the upper body 110 to be changed abruptly), results in a main body that can easily accommodate movement in any direction, and therefore increases in the efficiency of the vacuum cleaner's operation.

Additionally, the free rotational movement of the upper body 110 prevents unnecessary stress from being applied to the base of the connecting hose 220.

As described above, the vacuum cleaner of the present invention is designed to have a main body that is divided into upper and lower bodies, with the upper body being joined to the lower body so as to be rotatable about the shaft inserted in the lower body. This construction allows the main body to change its direction of movement for easy cleaning, and prevents damage to the connecting hose.

What is claimed is:

1. A vacuum cleaner comprising:

a main body including an upper body to generate a vacuum and a lower body to support the upper body;

a coupler to join the upper body to the lower body to allow the upper body to rotate on the lower body, wherein a top end of said coupler is fixed on a bottom center of the upper body and a bottom end of said coupler is rotatably disposed on a top center of the lower body; and a bearing member installed between a bottom surface and a top surface of the upper body to reduce frictional resistance therebetween, said bearing member including grooves formed on a ton surface of the lower body and balls seated in and movable freely within the grooves, wherein outer circumferences of the balls touch the bottom surface of the upper body.

2. A vacuum cleaner as set forth in claim 1, wherein the coupler includes a shaft having the top end which is fixed on the bottom center of the upper body and the bottom end which is rotatably joined to the top center of the lower body.

3. The vacuum cleaner as set forth in claim 2, wherein the shaft has a catching member which prevents dislocation of the shaft from the lower body.

* * * * *